US012669072B2

(12) United States Patent
Udaka et al.

(10) Patent No.: US 12,669,072 B2
(45) Date of Patent: Jun. 30, 2026

(54) VALVE OPENING-CLOSING TIMING CONTROL DEVICE

(71) Applicant: AISIN CORPORATION, Kariya (JP)

(72) Inventors: Masato Udaka, Kariya (JP); Yoshiaki Yamakawa, Kariya (JP); Kenji Ikeda, Kariya (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 19/019,841

(22) Filed: Jan. 14, 2025

(65) Prior Publication Data

US 2025/0297560 A1 Sep. 25, 2025

(30) Foreign Application Priority Data

Mar. 25, 2024 (JP) ..... 2024-048116

(51) Int. Cl.
*F01L 1/344* (2006.01)

(52) U.S. Cl.
CPC . *F01L 1/34403* (2013.01); *F01L 2001/34483* (2013.01); *F01L 2810/03* (2013.01)

(58) Field of Classification Search
CPC ..... F01L 2810/03; F01L 2810/04; F01L 2001/34483; F01L 1/34403
See application file for complete search history.

(56) References Cited

U.S. PATENT DOCUMENTS 10,731,521 B2 * 8/2020 Miyachi ..... F01L 1/047
2019/0277168 A1 * 9/2019 Mukaide ..... F01L 1/34403
2021/0017884 A1 * 1/2021 Sano ..... F01L 1/352

FOREIGN PATENT DOCUMENTS

JP 2008-38886 A 2/2008

* cited by examiner

*Primary Examiner* — Ngoc T Nguyen
(74) *Attorney, Agent, or Firm* — Sughrue Mion, PLLC

(57) ABSTRACT

A valve opening-closing timing control device includes an eccentric member that meshes an external teeth portion of an input gear with an internal teeth portion of an output gear. A concave portion on the eccentric member allows a spring member to be arranged in the concave portion. The spring member applies biasing force of meshing the external teeth portion with the internal teeth portion. The concave portion includes a spring support surface that receives biasing force of the spring member. When viewed in a direction along an eccentric axis, a top surface on the spring support surface has a smaller protrusion amount at a circumferential-direction central position of the spring support surface, as compared to an eccentric arc surface whose center is the eccentric axis.

6 Claims, 8 Drawing Sheets

VALVE OPENING-CLOSING TIMING CONTROL DEVICE

CROSS REFERENCE TO RELATED APPLICATIONS

This application is based on and claims priority under 35 U.S.C. § 119 to Japanese Patent Application 2024-048116, filed on Mar. 25, 2024, the entire content of which is incorporated herein by reference.

TECHNICAL FIELD

This disclosure generally relates to a valve opening-closing timing control device.

BACKGROUND DISCUSSION

A valve timing device described as a valve opening-closing timing control device in JP2008-38886A (Reference 1) has a configuration in which a concave accommodation portion (64) is formed on an eccentric outer circumferential surface (40) of a planetary carrier (32 in Reference 1), a spring member (70) is fitted into the accommodation portion (64), and elastic force of the spring member (70) is applied to a planetary gear (33).

In the configuration of Reference 1, the spring member (70) applies the elastic force to an external gear portion (39) of the planetary gear (33) along an application line (L) toward an internal gear portion (31), and the application line (L) is inclined from an eccentric direction line (E).

As described also in Reference 1, the concave accommodation portion includes a support surface (a surface on a side of a rotation center line (O)) against which the spring member contacts, a central portion of the support surface has a shape gradually protruding outward, and a support surface of the spring member is formed into a shape gradually curved along the protruding shape. The concave accommodation portion includes wall-shaped portions formed at both ends of a circumferential direction of the planetary carrier in order to restrict movement of the spring member in the circumferential direction.

The valve opening-closing timing control device rotates at a high speed. It is desirable that, even when a position of the spring member fluctuates in the concave accommodation portion because of a relation between a spring load and a vibration, a load fluctuation is small.

In contrast to this, it is also anticipated that the spring member may be displaced since a position fluctuation of the spring member cannot be sufficiently regulated even in a case of the accommodation portion configured to include the wall-shaped portions formed at the end portions of the circumferential direction of the planetary carrier similarly to the accommodation portion in Reference 1.

It is concerned that a displacement of the spring member changes a relation between the protruding portion on the support surface of the accommodation portion and a position of the spring member contacting against the protruding portion, and causes a load of the spring member to fluctuate, resulting in a vibration increase.

A need thus exists for a valve opening-closing timing control device, which is not susceptible to the drawback mentioned above.

SUMMARY

A valve opening-closing timing control device according to this disclosure includes: a driving-side rotor that rotates around a rotation axis synchronously with a crankshaft of an internal combustion engine; a driven-side rotor that is arranged on an inner side of the driving-side rotor coaxially with the rotation axis and rotates integrally with a camshaft for opening and closing a valve of the internal combustion engine; and a phase adjustment mechanism that adjusts a relative rotational phase between the driving-side rotor and the driven-side rotor, wherein the phase adjustment mechanism includes: an internal-teeth output gear that rotates integrally with the driven-side rotor around the rotation axis as a common axis; an external-teeth input gear that has a smaller number of teeth than the output gear, is arranged on an inner side of the output gear, and rotates around an eccentric axis oriented in parallel to the rotation axis; a coupling member that links the input gear to rotation of the driving-side rotor; an eccentric member that meshes an external teeth portion of the input gear with an internal teeth portion of the output gear; and an electric actuator that drives the eccentric member to rotate around the rotation axis, a concave portion is formed on the eccentric member, and is concave from an outer surface of the eccentric member inward in a radial direction in such a way as to allow a spring member to be arranged in the concave portion, the spring member applies biasing force of meshing the external teeth portion of the input gear with the internal teeth portion of the output gear, the concave portion includes a spring support surface that receives biasing force of the spring member, the spring support surface includes a top surface, and, when viewed in a direction along the eccentric axis, the top surface has a smaller protrusion amount at a circumferential-direction central position of the spring support surface, as compared to an eccentric arc surface whose center is the eccentric axis.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

The following describes an embodiment of a valve opening-closing timing control device according to this disclosure with reference to the drawings. However, without limitation to the following embodiment, various modifications can be made within a range that does not depart from the essence of this disclosure.

The following describes an embodiment of this disclosure with reference to the drawings.

Basic Configuration

Figure 1:
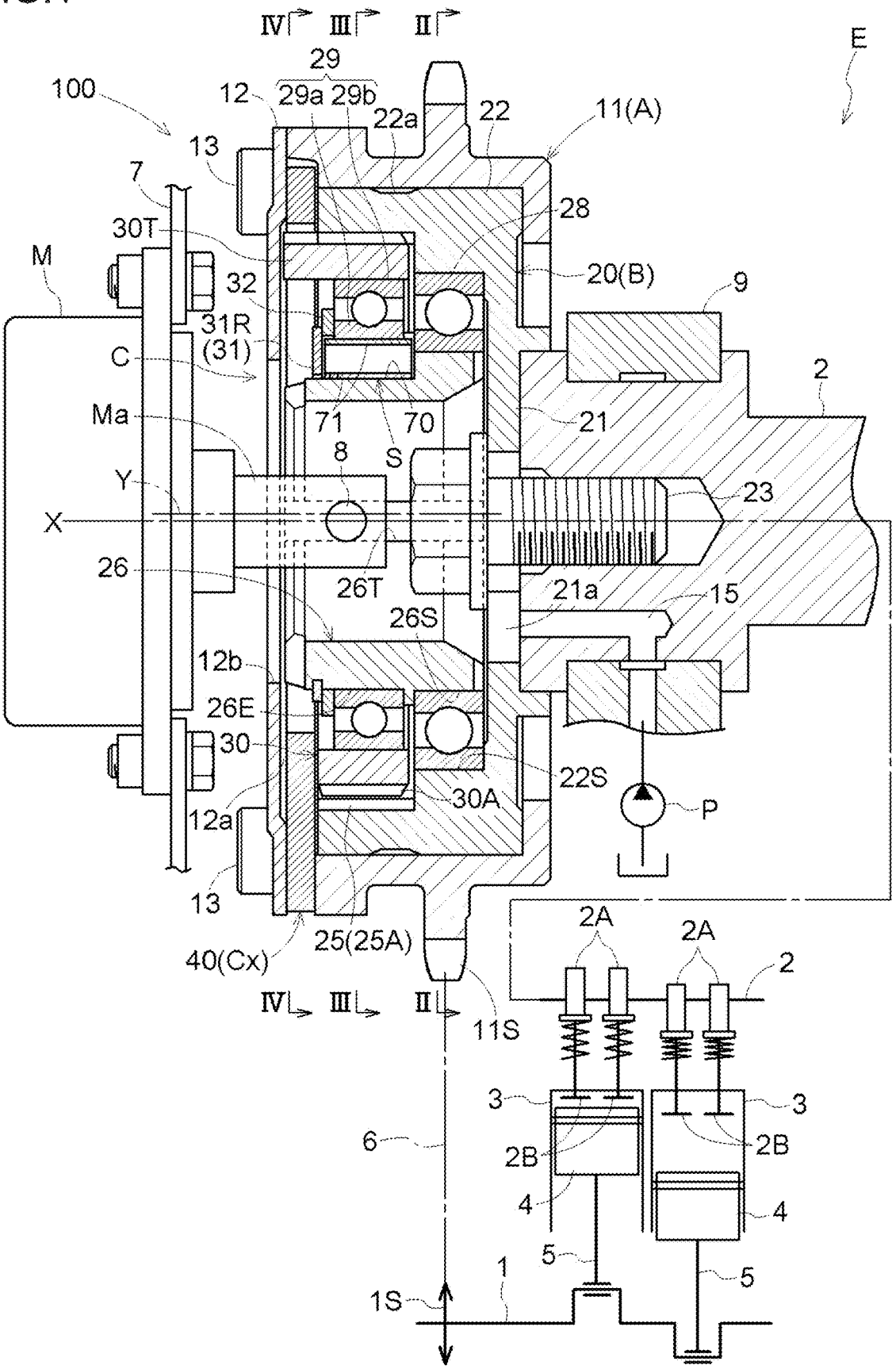
FIG. 1 is a sectional view of a valve opening-closing timing control device.

As illustrated in FIG. 1, a valve opening-closing timing control device 100 according to this embodiment includes a driving-side rotor A that rotates synchronously with a crankshaft 1 of an engine E as an internal combustion engine, a driven-side rotor B that rotates integrally with an intake camshaft 2 opening and closing intake valves 2B (one example of a valve), and a phase adjustment mechanism C that sets a relative rotational phase between the driving-side rotor A and the driven-side rotor B by drive force of a phase control motor M.

The valve opening-closing timing control device 100 includes the driving-side rotor A and the driven-side rotor B that are freely rotatable relative to each other around a rotation axis X within a set range.

The engine E is configured as a four-cycle engine in which pistons 4 are accommodated in a plurality of cylinders 3 formed in a cylinder block, and these pistons 4 are coupled to the crankshaft 1 by connecting rods 5. A timing chain 6 (or a timing belt or the like) is wound around an output sprocket 1S of the crankshaft 1 of the engine E and a driving sprocket 11S of the driving-side rotor A.

Thereby, at the time of operation of the engine E, the entire valve opening-closing timing control device 100 rotates around the rotation axis X. The phase adjustment mechanism C sets a relative rotational phase between the driving-side rotor A and the driven-side rotor B by drive force of the phase control motor M, and thereby implements control of timings of opening and closing the intake valves 2B by cam portions 2A of the intake camshaft 2.

Valve Opening-Closing Timing Control Device

As illustrated in FIG. 1, the driving-side rotor A includes an outer case 11 including an outer circumference on which the driving sprocket 11S is formed, and a front plate 12 fastened to the outer case 11 by a plurality of fastening bolts 13. The outer case 11 is a cylindrical case including a bottom on which an opening is formed.

As illustrated in FIG. 1 to FIG. 5, an intermediate member 20 as the driven-side rotor B, and the phase adjustment mechanism C (refer to FIG. 3 and the like) including a reduction gear mechanism are accommodated in an internal space of the outer case 11. The phase adjustment mechanism C includes an Oldham coupling Cx (refer to FIG. 4 and FIG. 5) that implements a phase change between the driving-side rotor A and the driven-side rotor B.

The intermediate member 20 includes a support wall portion 21 and a cylindrical wall portion 22 that are formed integrally with each other. The support wall portion 21 is coupled to the intake camshaft 2 while oriented perpendicular to the rotation axis X. The cylindrical wall portion 22 has a cylindrical shape whose center coincides with the rotation axis X, and protrudes in a direction of being separated from the intake camshaft 2.

The intermediate member 20 is fitted into the outer case 11 in such a way as to be freely rotatable relative to the outer case 11 while an outer surface of the cylindrical wall portion 22 contacts with an inner surface of the outer case 11. The intermediate member 20 is fixed to the end portion of the intake camshaft 2 by a coupling bolt 23 inserted into a central penetration hole of the support wall portion 21.

Figure 5:
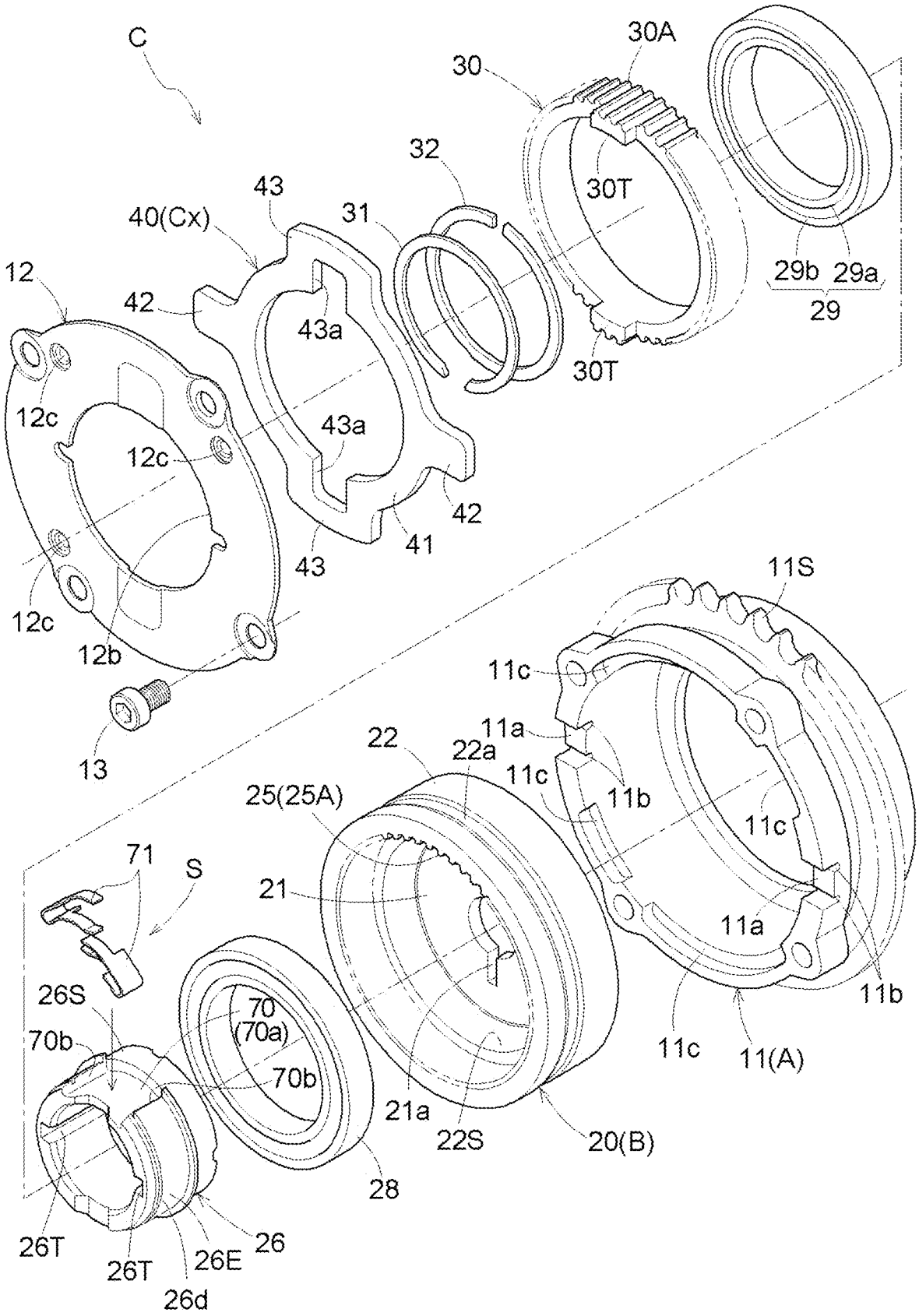
FIG. 5 is an exploded perspective view of the valve opening-closing timing control device.

As illustrated in FIG. 1 and FIG. 5, a groove 22*a* for retaining a lubricating oil is formed on an outer circumference of the cylindrical wall portion 22, entirely around the cylindrical wall portion 22.

As illustrated in FIG. 1, the phase control motor M is supported by the engine E via a support frame 7 in such a way that an output shaft Ma of the phase control motor M is arranged coaxially with the rotation axis X. A pair of engagement pins 8 are formed on the output shaft Ma of the phase control motor M while oriented perpendicular to the rotation axis X (refer also to FIG. 4).

Phase Adjustment Mechanism

As illustrated in FIG. 1 and FIG. 5, the phase adjustment mechanism C includes the intermediate member 20, an output gear 25 formed on an inner circumferential surface of the cylindrical wall portion 22 of the intermediate member 20, an eccentric member 26, a biasing mechanism S, a first bearing 28, a second bearing 29, an input gear 30, a fixing ring 31, a ring-shaped spacer 32, and the Oldham coupling Cx. Although rolling bearings are used as the first bearing 28 and the second bearing 29, sliding bearings may also be used as the first bearing 28 and the second bearing 29.

As illustrated in FIG. 1, an inner circumference of the cylindrical wall portion 22 of the intermediate member 20 includes a support surface 22S and the output gear 25. The support surface 22S is formed on an inner side (at a position adjacent to the support wall portion 21) in a direction (hereinafter, referred to as the axial direction) along the rotation axis X. The support surface 22S has a center that coincides with the rotation axis X. The output gear 25 is formed, integrally with the support surface 22S, on an outer side (on a side farther from the intake camshaft 2) of the support surface 22S. The output gear 25 has a center that coincides with the rotation axis X.

Figure 2:
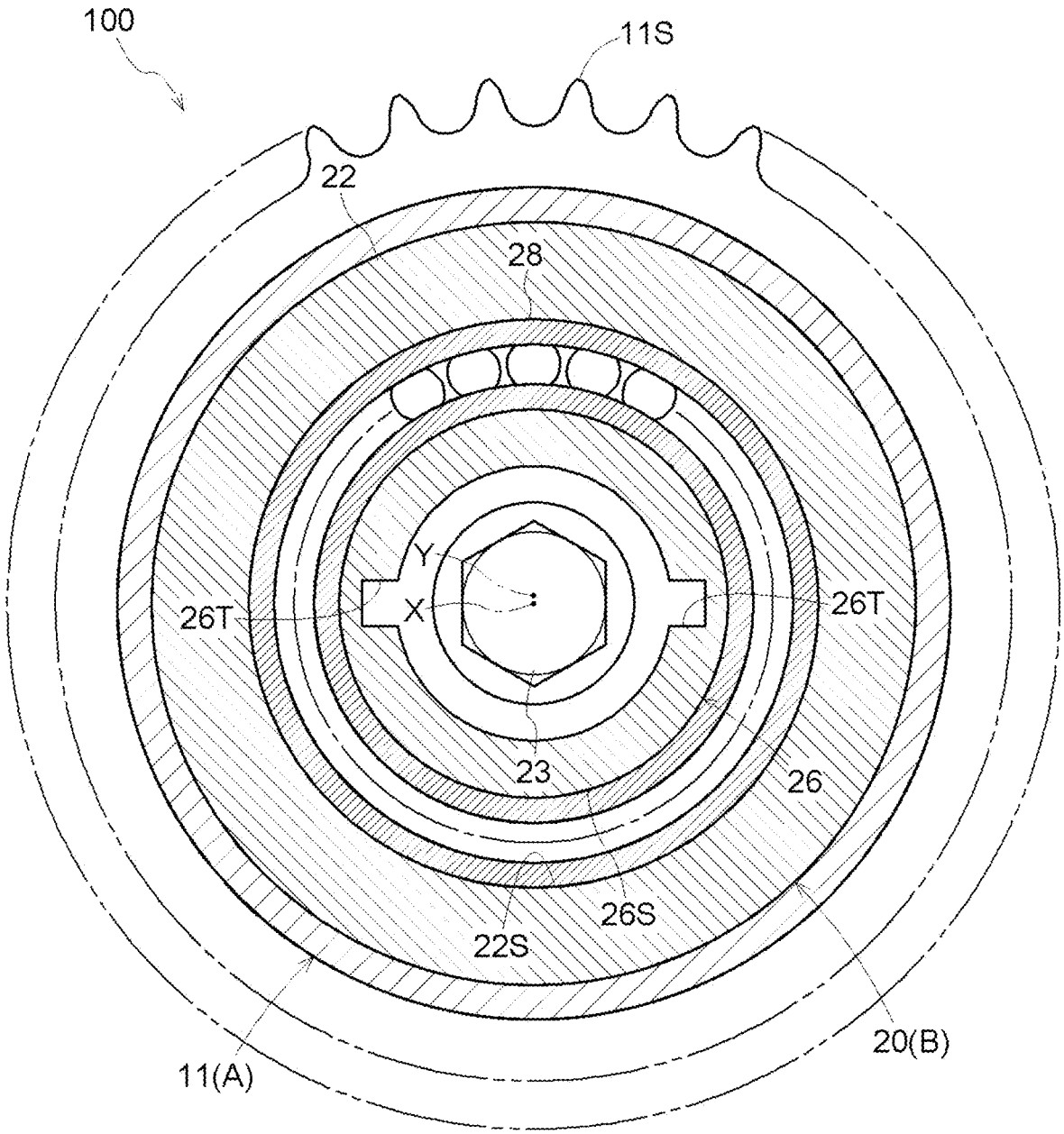
FIG. 2 is a cross-sectional view taken along the II-II line in FIG. 1.
Figure 3:
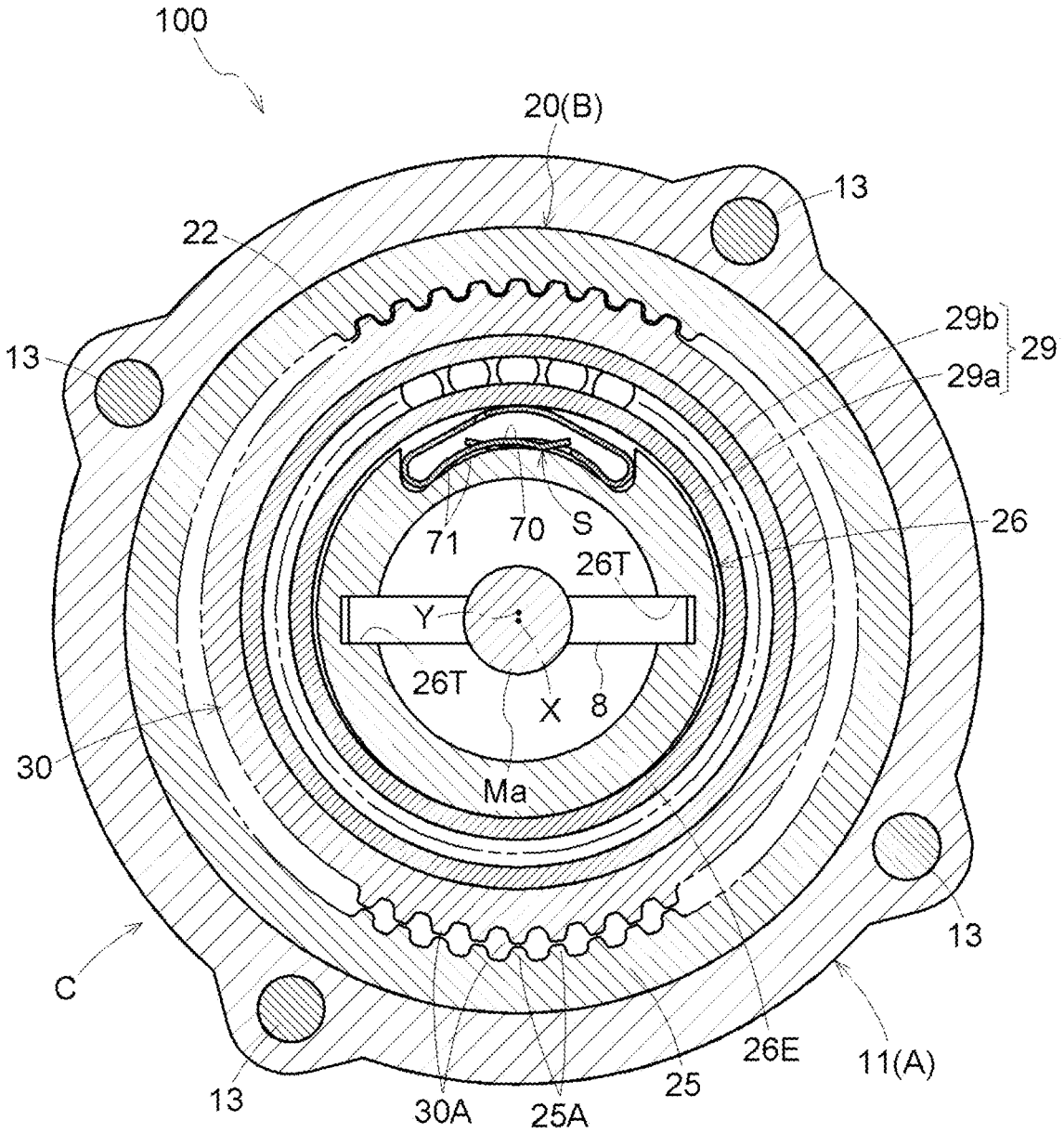
FIG. 3 is a cross-sectional view taken along the III-III line in FIG. 1.

As illustrated in FIG. 1, FIG. 2, and FIG. 5, the eccentric member 26 is cylindrical. The eccentric member 26 includes a circumferential support surface 26S that is formed on an inner side (a side closer to the intake camshaft 2) in the axial direction and that is an outer circumferential surface whose center coincides with the rotation axis X. As illustrated in FIG. 1, FIG. 3, and FIG. 5, the eccentric member 26 includes an eccentric support surface 26E that is formed on an outer side (a side farther from the intake camshaft 2) while oriented parallel to the rotation axis X and that is an outer circumferential surface whose center coincides with an eccentric axis Y. A direction along the eccentric axis Y is the same as the axial direction, and thus, hereinafter, the direction along the eccentric axis Y is also referred to simply as the axial direction.

Figure 6:
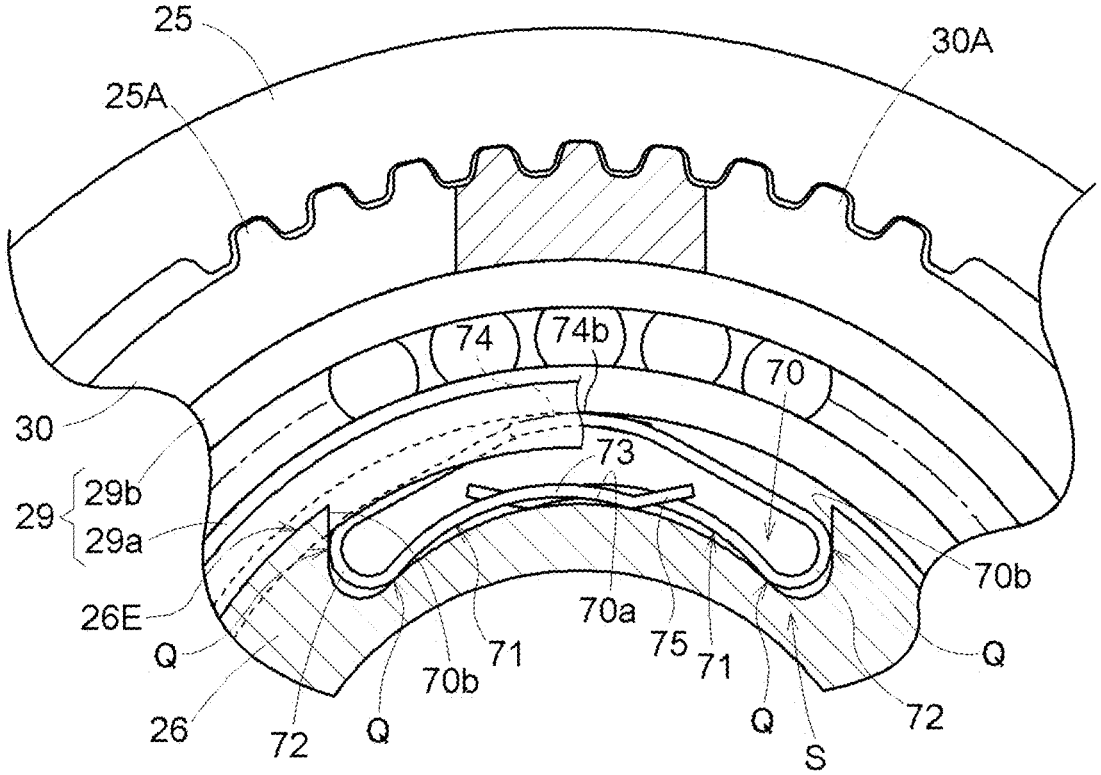
FIG. 6 is an enlarged view illustrating a positional relation among a concave portion, spring members, an output gear, and an input gear.

As illustrated in FIG. 5 and FIG. 6, a concave portion 70 is formed in the eccentric support surface 26E in such a way as to be concave inward in a radial direction of the eccentric member 26 and be opened in an end direction (an outer end direction: a direction toward the front plate 12) in the axial direction. The concave portion 70 includes a spring support surface 70*a*, and includes end wall surfaces 70*b* at both ends of the concave portion 70 in a circumferential direction.

Figure 8:
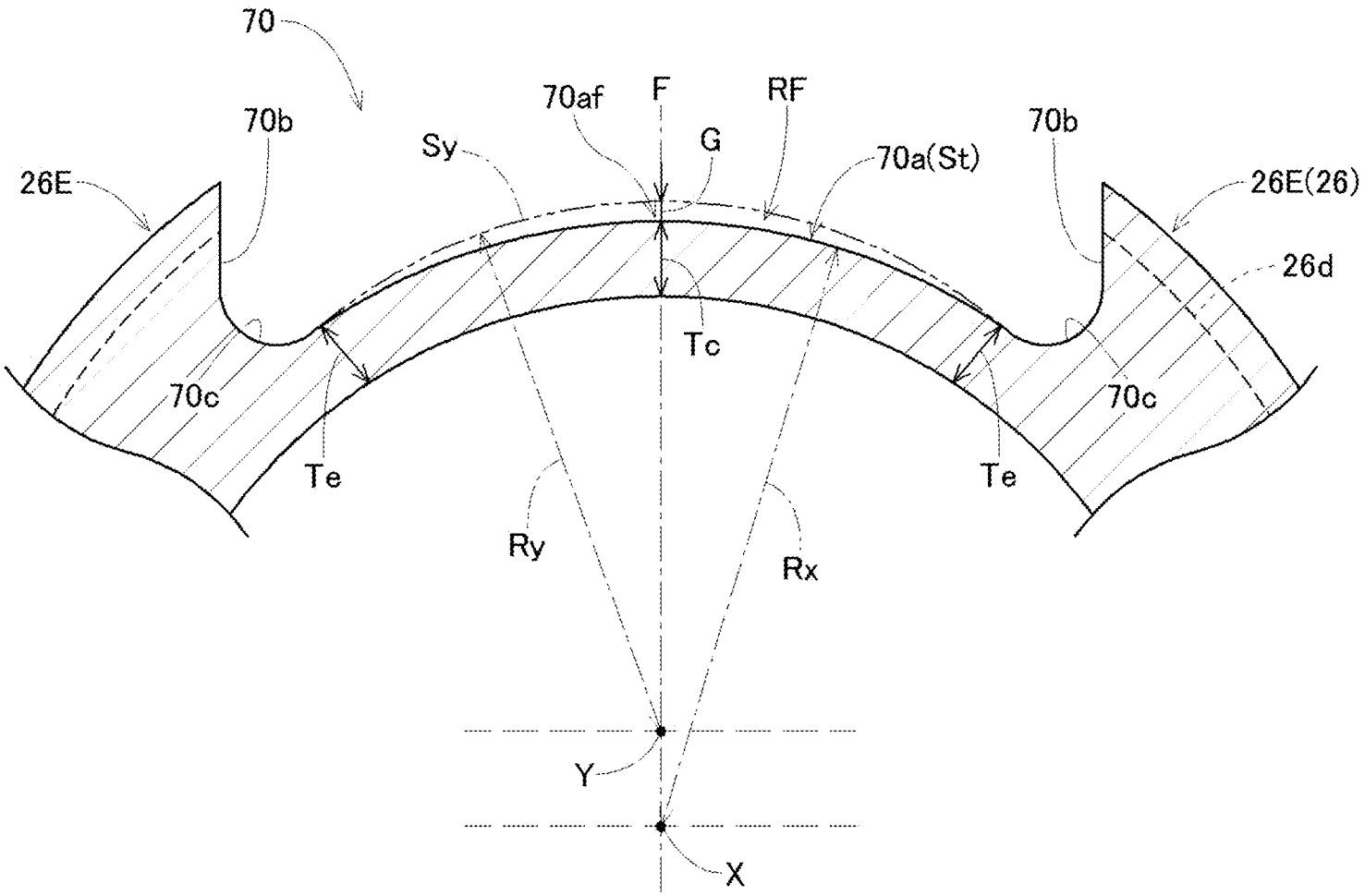
FIG. 8 is a cross-sectional view illustrating a shape of a spring support surface.
Figure 9:
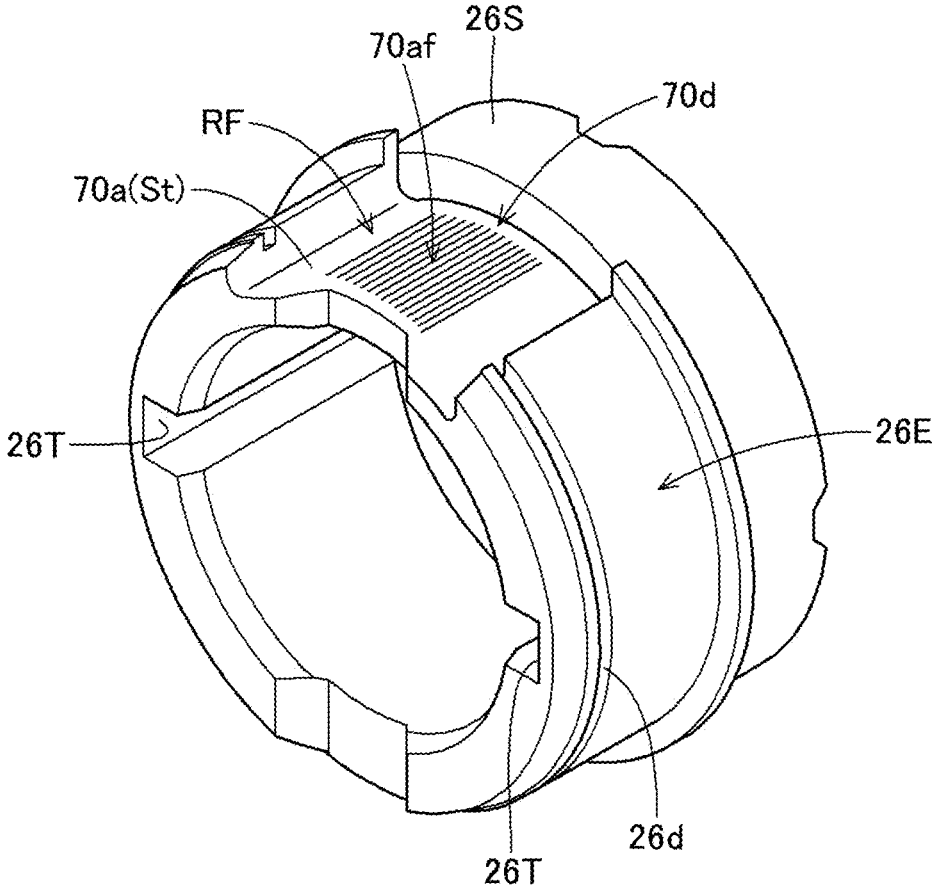
FIG. 9 is a perspective view of an eccentric member and illustrates a position of a rough surface.

As illustrated in FIG. 6 and FIG. 8, the spring support surface 70*a* is formed in a shape in which a central portion of the spring support surface 70*a* in the circumferential direction is displaced inward in the radial direction from a circular arc surface whose center coincides with the eccentric axis Y (the details of this configuration is described below). As illustrated in FIG. 6, FIG. 8 and FIG. 9, a pair of the end wall surfaces 70*b* are flat when viewed in the direction along the eccentric axis Y, and are formed symmetrically to each other in the circumferential direction.

A pair of spring members 71 constituting the biasing mechanism S as described below are fitted into the concave portion 70.

As illustrated in FIG. 1 and FIG. 5, a pair of engagement grooves 26T are formed in an inner circumference of the eccentric member 26 while oriented parallel to the rotation axis X. A pair of the engagement pins 8 of the phase control motor M (refer to FIG. 1) can engage with a pair of the respective engagement grooves 26T.

As illustrated in FIG. 1, FIG. 2, FIG. 3, and FIG. 6, the first bearing 28 is fitted onto the circumferential support surface 26S, and the first bearing 28 is fitted into the support surface 22S of the cylindrical wall portion 22. Thereby, the eccentric member 26 is supported by the intermediate member 20 freely rotatably around the rotation axis X relative to the intermediate member 20. As illustrated in FIG. 1 and FIG. 3, the input gear 30 is supported via the second bearing 29 by the eccentric support surface 26E freely rotatably around the eccentric axis Y relative to the eccentric support surface 26E of the eccentric member 26.

In the phase adjustment mechanism C, the number of teeth of an external teeth portion 30A of the input gear 30 is smaller by one than the number of teeth of an internal teeth portion 25A of the output gear 25, and a part of the external teeth portion 30A of the input gear 30 meshes with a part of the internal teeth portion 25A of the output gear 25.

The biasing mechanism S including a pair of the spring members 71 applies biasing force to the input gear 30 via the second bearing 29 in such a way as to mesh a part of the external teeth portion 30A of the input gear 30 with a part of the internal teeth portion 25A of the output gear 25. An inner race 29*a* of the second bearing 29 is fitted onto the eccentric support surface 26E of the eccentric member 26, and an outer race 29*b* of the second bearing 29 is fitted into an inner circumference of the input gear 30 so that the biasing force of the biasing mechanism S is applied to the input gear 30 in the radial direction.

Figure 7:
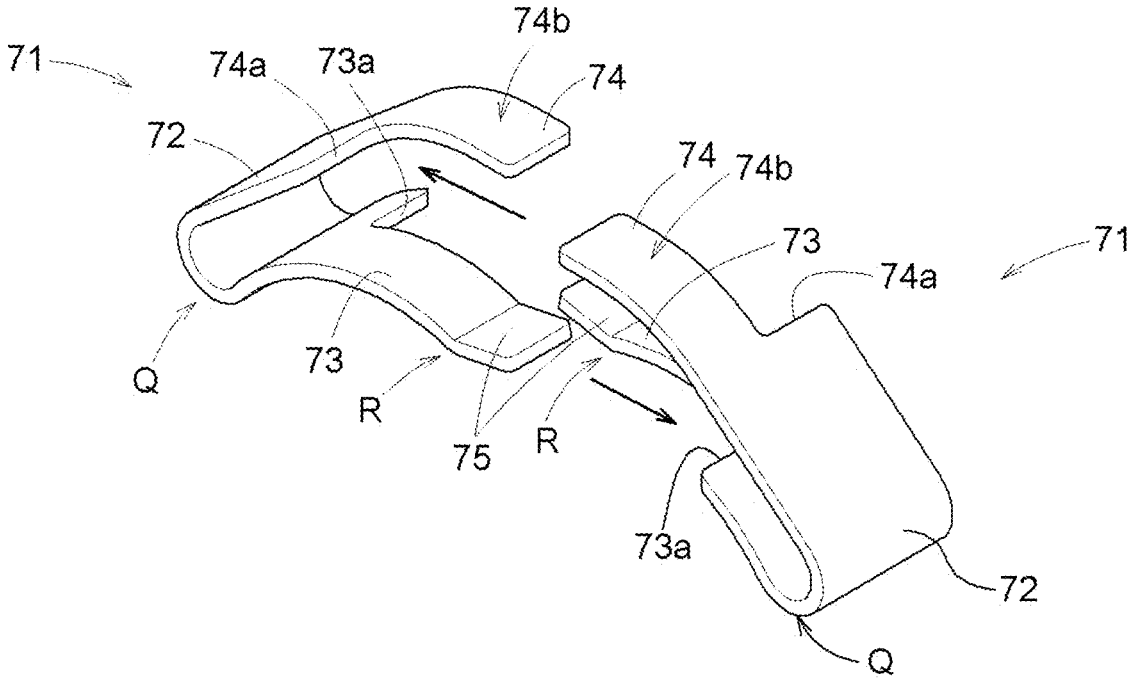
FIG. 7 is a perspective view of a pair of the spring members.

The biasing mechanism S is configured by combining a pair of the spring members 71 having the same shape and size as illustrated in FIG. 7.

As illustrated in FIG. 6 and FIG. 7, the spring members 71 each includes\ a curved portion 72, a support portion 73, and a biasing portion 74 that are formed integrally with each other. The curved portion 72 is constituted by a curved spring plate material. The support portion 73 extends from one side of the spring plate material of the curved portion 72, and faces the spring support surface 70*a* of the concave portion 70. The biasing portion 74 extends from an opposite side of the spring plate material of the curved portion 72, and applies the biasing force to an inner circumference side in the input gear 30. The spring members 71 each include a bent portion 75 that is a distal end side of the support portion 73 and that is bent in an orientation of being separated from the spring support surface 70*a* of the concave portion 70.

In other words, the spring plate material is bent in such a way as to have a U-shape when viewed in the direction along the eccentric axis Y, in a state where the curved portion 72 is fitted into the concave portion 70. Thereby, the curved portion 72 is formed into a shape in which the support portion 73 and the biasing portion 74 are arranged in orientations that make the support portion 73 and the biasing portion 74 substantially parallel to each other.

Thus, as illustrated in FIG. 7, a support-side notch portion 73*a* oriented along a width direction is formed at a boundary portion between the curved portion 72 and the support portion 73, and a biasing-side notch 74*a* oriented along the width direction is formed at a boundary portion between the curved portion 72 and the biasing portion 74.

In the direction view illustrated in FIG. 6 and FIG. 7, the two spring members 71 are configured as the biasing mechanism S in which the two spring members 71 are arranged in mutually opposite orientations in such a way that the respective curved portions 72 are arranged at circumferential-direction ends of the concave portion 70. Thus, the two spring members 71 are fitted into the one concave portion 70. The two spring members 71 are fitted in this manner, and thereby, the respective curved portions 72 are separated from each other, and the two biasing portions 74 are arranged side by side along the axial direction.

In the spring member 71, an area extending from the curved portion 72 to the support portion 73 is curved along the spring support surface 70*a* of the concave portion 70, forms a base-end-side contact portion Q at a position included in the curved portion 72 and facing the spring support surface 70*a*, and forms a distal-end-side contact portion R at a boundary between the support portion 73 and the bent portion 75.

Further, as illustrated in FIG. 6, the biasing portion 74 includes a biasing top portion 74*b* that protrudes outward in the radial direction of the eccentric member 26 in such a way as to apply biasing force to an inner surface of the inner race 29*a* of the second bearing 29, concentratedly in a direction in which the external teeth portion 30A of the input gear 30 meshes most deeply with the internal teeth portion 25A of the output gear 25.

The curved portion 72 is a main part that generates the biasing force of the spring member 71 by being elastically deformed. The two spring members 71 are combined to be fitted into the concave portion 70, and thereby, as illustrated in FIG. 6 and FIG. 7, the biasing top portions 74*b* of the respective biasing portions 74 of the two spring members 71 are arranged at positions where the biasing top portions 74*b* overlap with each other when viewed in the direction along the eccentric axis Y. Thus, even with a structure in which the two spring members 71 are fitted into the one concave portion 70, balance of the biasing force applied to the input gear 30 can be maintained.

Thereby, the biasing force from the biasing top portions 74*b* of the two biasing portions 74 can be applied to the inner race 29*a* of the second bearing 29 in a state where the base-end-side contact portion Q at the boundary between the support portion 73 and the curved portion 72 of each of the two spring members 71 contacts as a fulcrum against the spring support surface 70*a* of the concave portion 70. When the biasing force is applied in this manner, the distal-end-side contact portion R as the boundary between the bent portion 75 and the support portion 73 is maintained in a state of contacting against the spring support surface 70*a* of the concave portion 70.

Fixing Ring and Spring Member

As illustrated in FIG. 1, FIG. 5, and FIG. 9, the fixing ring 31 is fitted into an annular groove 26*d* formed in an annular shape on the outer circumference of the eccentric support surface 26E of the eccentric member 26. The valve opening-closing timing control device 100 includes the spacer 32 at a position of contacting with the fixing ring 31, thereby preventing the second bearing 29 from coming off.

Phase Adjustment Mechanism: Oldham Coupling

Figure 4:
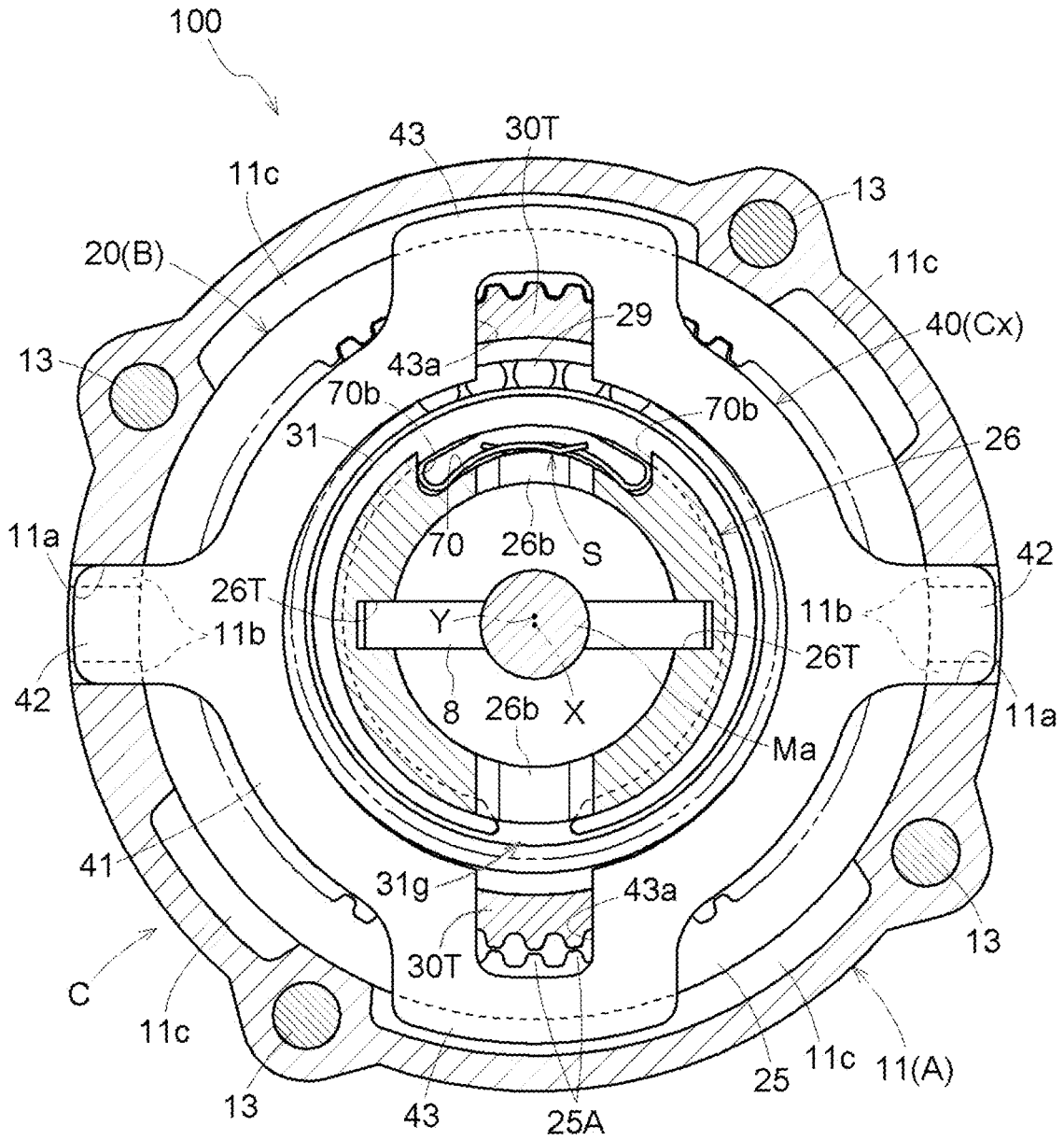
FIG. 4 is a cross-sectional view taken along the IV-IV line in FIG. 1.

As illustrated in FIG. 1, FIG. 4, and FIG. 5, the Oldham coupling Cx is constituted by a plate-shaped coupling member 40 in which a central annular portion 41, a pair of external engagement arms 42, and internal engagement arms 43 are formed integrally with each other. A pair of the external engagement arms 42 protrude from the annular portion 41 outward in the radial direction along a first direction (the left-right direction in FIG. 4). The internal engagement arms 43 protrude from the annular portion 41 outward in the radial direction along a direction (the up-down direction in FIG. 4) perpendicular to the first direction. A pair of the internal engagement arms 43 each include an engagement concave portion 43*a* formed to be continuous with an opening of the annular portion 41.

A pair of guide grooves 11*a* are formed in penetration-groove shapes at an opening edge portion that is included in the outer case 11 and against which the front plate 12 contacts. The guide grooves 11*a* extend from an internal space of the outer case 11 to an external space, and extend in the radial direction with respect to the center as the rotation axis X. The guide grooves 11*a* each have a groove width that is set slightly wider than a width of the external engagement arm 42, and a pair of discharge flow paths 11*b* are formed by cutting in each of the guide grooves 11*a*. The discharge flow paths 11*b* may be formed in the front plate 12 in such a way as to allow a lubricating oil to flow in the radial direction.

The outer case 11 includes pockets 11*c* each formed by cutting along the circumferential direction on an inner circumferential side, at a part that is included in the opening edge portion and that is other than the guide groove portions 11*a*. The pockets 11*c* each collect foreign objects that move to an outer circumferential side by receiving centrifugal force generated by the rotation of the driving-side rotor A.

The input gear 30 includes a pair of engagement projections 30T formed, integrally with the input gear 30, on an end surface facing the front plate 12. The engagement projections 30T each have an engagement width that is set slightly narrower than an engagement width of the engagement concave portion 43*a* of the internal engagement arm 43.

Thus, a pair of the external engagement arms 42 of the coupling member 40 are made to engage with a pair of the guide groove portions 11*a* of the outer case 11, and a pair of the engagement projections 30T of the input gear 30 are made to engage with the engagement concave portions 43*a* of a pair of the internal engagement arms 43 of the coupling member 40, thereby allowing the Oldham coupling Cx to function.

The coupling member 40 can be displaced relative to the outer case 11 in the first direction (the left-right direction in FIG. 4) in which the external engagement arms 42 extend. The input gear 30 can be freely displaced relative to the coupling member 40 in the second direction (the up-down direction in FIG. 4) along a forming direction of the engagement concave portions 43*a* of the internal engagement arms 43.

Lubrication of Phase Adjustment Mechanism

As illustrated in FIG. 1, a lubricating oil path 15 is formed in the intake camshaft 2. A lubricating oil is supplied to the lubricating oil path 15 from an external oil pump P via an oil path forming member 9. The support wall portion 21 of the intermediate member 20 includes an opening 21*a* that is formed on a part of the surface contacting against the intake camshaft 2 and that guides the oil to an inside of the eccentric member 26.

The lubricating oil is supplied from the opening 21*a* to the eccentric member 26. A lubrication concave portion 12*a* is formed along the radial direction on the surface that is included in the front plate 12 and that faces the coupling member 40. The lubrication concave portion 12*a* is serves as a gap from the surface of the coupling member 40. The lubricating oil is supplied also to the lubrication concave portion 12*a*. The lubrication concave portion 12*a* is formed on an inner circumferential side on the front plate 12. However, the lubrication concave portion 12*a* may be formed in an area that reaches an outer circumference of the front plate 12. Alternatively, a configuration without the lubrication concave portion 12*a* may be adopted in such a way that the lubricating oil is supplied to a gap between the front plate 12 and the coupling member 40.

As described above, a pair of the discharge flow paths 11*b* are formed in the guide groove portion 11*a* (refer to FIG. 4 and FIG. 5). Further, an opening diameter of the opening 12*b* of the front plate 12 is made sufficiently larger than an inner diameter of the eccentric member 26, and thereby, a difference in an opening diameter is set between an opening edge of the front plate 12 and the inner circumference of the eccentric member 26.

With this configuration, the lubricating oil supplied from the oil pump P is supplied from the lubricating oil path 15 of the intake camshaft 2 to the internal space of the eccentric member 26 via the opening 21*a* of the support wall portion 21 of the intermediate member 20. The lubricating oil supplied in this manner is supplied from the eccentric member 26 to the first bearing 28 by the centrifugal force, and thus causes the first bearing 28 to operate smoothly.

At the same time, the lubricating oil in the internal space of the eccentric member 26 is supplied to the coupling member 40 by the centrifugal force, is also supplied to the second bearing 29, and is supplied between the internal teeth portion 25A of the output gear 25 and the external teeth portion 30A of the input gear 30.

As illustrated in FIG. 1, the lubricating oil from the second bearing 29 is supplied between the front plate 12 and the coupling member 40 by the lubrication concave portion 12*a*, and is also supplied to gaps between the external engagement arms 42 of the coupling member 40 and the guide groove portions 11*a* of the outer case 11 (refer also to FIG. 5). The lubricating oil supplied to the coupling member 40 is discharged to an outside from the gaps between the external engagement arms 42 of the coupling member 40 and the guide groove portions 11*a* of the outer case 11.

As illustrated in FIG. 5, the front plate 12 includes convex portions 12*c* that are formed on a surface on an inner side (a side closer to the intake camshaft 2) and that protrude to the inner side. The convex portions 12*c* are made to contact with the intermediate member 20 lightly to the extent of being slidable on the intermediate member 20. By contacting against the convex portions 12*c*, the intermediate member 20 is restricted from moving toward the front plate 12. Thereby, the Oldham coupling Cx (coupling member 40) is enabled to smoothly (uninterruptedly) operate in a state where a predetermined gap is maintained between the front plate 12 and the intermediate member 20.

Operation Mode of Phase Adjustment Mechanism

The phase control motor M is controlled by a control device configured as an ECU which is not illustrated in the drawings. The control device includes sensors that detect rotation speeds (the number of rotations per unit time) of the crankshaft 1 and the intake camshaft 2 in the engine E and respective rotation phases of the crankshaft 1 and the intake camshaft 2. Detection signals of these sensors are input to the control device.

When the engine E is operating, the control device maintains the relative rotational phase by driving the phase control motor M at a speed equal to a rotational speed of the intake camshaft 2. In contrast to this, advance angle operation is performed by reducing a rotational speed of the phase control motor M to be lower than a rotational speed of the intake camshaft 2, and conversely, retard angle operation is performed by increasing the rotational speed.

When the phase control motor M rotates at the same speed (the same speed as that of the intake camshaft 2) as that of the outer case 11, a meshing position of the external teeth portion 30A of the input gear 30 with the internal teeth portion 25A of the output gear 25 does not vary, and thus, a relative rotational phase of the driven-side rotor B to the driving-side rotor A is maintained.

In contrast to this, driving the output shaft Ma of the phase control motor M to rotate at a speed higher or lower than a rotational speed of the outer case 11 causes the eccentric axis Y in the phase adjustment mechanism C to revolve around the rotation axis X. This revolution causes a meshing position of the external teeth portion 30A of the input gear 30 with the internal teeth portion 25A of the output gear 25 to be displaced along the inner circumference of the output gear 25, and rotational force is applied between the input gear 30 and the output gear 25. In other words, the rotational force around the rotation axis X is applied to the output gear 25, and the rotational force to rotate the input gear 30 around the eccentric axis Y is applied to the input gear 30.

As described above, the engagement projections 30T engage with the engagement concave portions 43*a* of the internal engagement arms 43 of the coupling member 40, and thus, the input gear 30 does not rotate relative to the outer case 11, and the rotational force is applied to the output gear 25. This rotational force causes the intermediate member 20 to rotate together with the output gear 25 around the rotation axis X relative to the outer case 11. As a result, the relative rotational phase between the driving-side rotor A and the driven-side rotor B is set, and the setting of timings of opening and closing by the intake camshaft 2 is implemented.

When the eccentric axis Y of the input gear 30 revolves around the rotation axis X, accompanying the displacement of the input gear 30, the coupling member 40 of the Oldham coupling Cx is displaced relative to the outer case 11 in the direction (first direction) in which the external engagement arms 42 extend, and the input gear 30 is displaced in the direction (second direction) in which the internal engagement arms 43 extend.

As described above, the number of the teeth of the external teeth portion 30A of the input gear 30 is set to be smaller by one than the number of the teeth of the internal teeth portion 25A of the output gear 25. Thus, when the eccentric axis Y of the input gear 30 revolves once around the rotation axis X, the output gear 25 rotates by an amount of the one tooth, thereby achieving large reduction in speed.

Concave Portion

As illustrated in FIG. 6 and FIG. 8, the concave portion 70 has a shape concave inward in the radial direction from the eccentric support surface 26E (one example of an eccentric outer surface) when viewed in the direction along the eccentric axis Y. When viewed in the direction along the eccentric axis Y, the end portions of the spring support surface 70*a* in the circumferential direction of the eccentric member 26 and the end wall surfaces 70*b* at both ends are formed in such a way as to be smoothly connected to each other by curved surfaces 70*c*.

When the two spring members 71 are fitted into the concave portion 70, the respective base-end-side contact portions Q each contact against the end wall surface 70*b* and the spring support surface 70*a*, and the respective distal-end-side contact portions R each contact against the spring support surface 70*a*.

The spring support surface 70*a* of the concave portion 70 is formed as a bulging surface St whose curvature radius is larger in such a way that the spring support surface 70*a* has a smaller protrusion amount at a circumferential-direction central position F (illustrated as the central line F in FIG. 8), as compared to an eccentric arc surface Sy having an eccentric-side radius Ry whose center is the eccentric axis Y. An area included in the bulging surface St and close to the central position F is referred to as a top surface 70*af*.

The bulging surface St is formed as an arc having a center-side radius Rx whose center is the rotation axis X. The bulging surface St is not limited to an arc surface, and may be, for example, a part of a curved line of an ellipse or a part of a curved line of a quadratic function.

In this configuration, a positional relation between the central position F on the eccentric arc surface Sy in the circumferential direction of the concave portion 70 and the central position F on the top surface 70*af* in the circumferential direction of the concave portion 70 is a positional relation in which these central positions F are separated from each other by a gap G in the radial direction.

The eccentric member 26 has a cylindrical shape including a cylindrical internal space whose center is the eccentric axis Y. The eccentric member 26 has a central thickness Tc that is a radial-direction thickness from the inner surface of the eccentric member 26 to the spring support surface 70*a* at the central position F. The central thickness Tc is set to be smaller than an end portion thickness Te that is a thickness from the inner surface of the eccentric member 26 to each of both circumferential-direction end portions of the spring support surface 70*a*.

A rough surface RF is formed on the top surface 70*af* of the spring support surface 70*a* by forming a plurality of groove-shaped portions 70*d* oriented along the eccentric axis Y. A plurality of the groove-shaped portions 70*d* are formed by a laser beam. The thus-formed rough surface RF functions in such a way as to suppress a phenomenon in which the spring member 71 moves in the circumferential direction relative to the spring support surface 70*a* (refer also to FIG. 9).

In this configuration, the two spring members 71 fitted into the concave portion 70 apply biasing force from the spring support surface 70*a* of the concave portion 70 toward the inner circumference of the input gear 30, and thus keeps the external teeth portion 30A of the input gear 30 in a state of meshing with the internal teeth portion 25A of the output gear 25.

In such a configuration, when viewed in the direction along the eccentric axis Y, the top surface 70*af* of the spring support surface 70*a* has a smaller protrusion amount at the circumferential-direction central position F on the spring support surface 70*a*, as compared to the eccentric arc surface Sy. For this reason, even when the spring member 71 is displaced inside the concave portion 70 in a direction away from the central position F, a change amount of the biasing force is smaller, and thus, a vibration is not caused when the valve opening-closing timing control device 100 rotates at a high speed.

The spring member 71 in this embodiment includes the distal-end-side contact portion R that contacts with a part on the spring support surface 70*a* and near the circumferential-direction central position F. Accordingly, when the spring member 71 is displaced inside the concave portion 70 in the direction away from the central position F, the distal-end-side contact portion R moves in a state of contacting with the top surface 70*af*. Thus, even when such a movement occurs, the biasing force applied from the spring member 71 is suppressed from fluctuating.

In this configuration, the rough surface RF is formed on the spring support surface 70*a*. Thus, as described above, when the spring member 71 moves in the circumferential direction of the spring support surface 70*a*, the frictional force is applied to the distal-end-side contact portion R, thereby enabling the movement of the spring member 71 to be suppressed.

Alternative Embodiments

This disclosure may be configured as follows, differently from the above-described embodiment (the constituents having the same functions as those in the embodiment are denoted by the common numbers and symbols in the embodiment).

(a) As partially described in the embodiment, the bulging surface St is not limited to an arc surface, and can have a shape that follows a part of a curve defining an ellipse, or a part of a curve expressing a quadratic function, or a curve having a shape of a plurality of functions connected to each other in such a way as to gradually protrude.

(b) The number of the used spring members 71 may be one.

(c) The rough surface RF may be formed by knurling, for example. The spring support surface 70*a* can be formed into the rough surface RF by using a device that performs surface processing.

The configuration disclosed in each of the above-described embodiments (including the alternative embodiments, which applies to the following) can be applied in combination with the configuration disclosed in another of the embodiments, as long as there is no contradiction, and the embodiments disclosed in this specification are illustrative, and the embodiments of this disclosure are not limited to these, and can be modified appropriately within the scope that does not deviate from the purpose of this disclosure.

In the above-described embodiment, the following configurations are assumed.

(1) The valve opening-closing timing control device 100 includes: the driving-side rotor A that rotates around a rotation axis X synchronously with the crankshaft 1 of the internal combustion engine (engine E); the driven-side rotor B that is arranged on an inner side of the driving-side rotor A coaxially with the rotation axis X and rotates integrally with the camshaft (intake camshaft 2) for opening and closing the valve of the internal combustion engine (engine E); and the phase adjustment mechanism C that adjusts a relative rotational phase between the driving-side rotor A and the driven-side rotor B. The phase adjustment mechanism C includes: an internal-teeth output gear 25 that rotates integrally with the driven-side rotor B around the rotation axis X as a common axis; an external-teeth input gear 30 that has a smaller number of teeth than the output gear 25, is arranged on an inner side of the output gear 25, and rotates around the eccentric axis Y oriented in parallel to the rotation axis X; the coupling member 40 that links the input gear 30 to rotation of the driving-side rotor A; the eccentric member 26 that meshes the external teeth portion 30A of the input gear 30 with the internal teeth portion 25A of the output gear 25; and the electric actuator (the phase control motor M) that drives the eccentric member 26 to rotate around the rotation axis X. The concave portion 70 is formed on the eccentric member 26, and is concave from the outer surface of the eccentric member 26 inward in the radial direction in such a way as to allow the spring member 71 to be arranged in the concave portion 70. The spring member 71 applies the biasing force of meshing the external teeth portion 30A of the input gear 30 with the internal teeth portion 25A of the output gear 25. The concave portion 70 includes the spring support surface 70*a* that receives the biasing force of the spring member 71. The spring support surface 70*a* includes the top surface 70*af*. When viewed in the direction along the eccentric axis Y, the top surface 70*af* has a smaller protrusion amount at the circumferential-direction central position F of the spring support surface 70*a*, as compared to the eccentric arc surface Sy whose center is the eccentric axis Y.

According to this configuration, the spring member 71 fitted into the concave portion 70 applies the biasing force from the spring support surface 70*a* of the concave portion 70 toward the inner circumference of the input gear 30, and thereby keeps the external teeth portion 30A of the input gear 30 in a state of meshing with the internal teeth portion 25A of the output gear 25. The top surface 70*af* is formed on the spring support surface 70*a* of the concave portion 70. When viewed in the direction along the eccentric axis Y, the top surface 70*af* has a smaller protrusion amount at the circumferential-direction central position F of the spring support surface 70*a*, as compared to the eccentric arc surface Sy whose center is the eccentric axis Y. This can suppress a phenomenon in which the biasing force applied from the spring member 71 largely fluctuates in the direction of meshing the external teeth portion 30A of the input gear 30 with the internal teeth portion 25A of the output gear 25, even when the spring member 71 is displaced in the circumferential direction inside the concave portion 70. Thereby, a vibration occurrence phenomenon can be suppressed even when the valve opening-closing timing control device 100 rotates at a high speed.

(2) In the valve opening-closing timing control device 100 of (1), it is preferable that the eccentric member 26 has the cylindrical shape including the cylindrical internal space whose center is the eccentric axis Y, the eccentric member 26 has the central thickness Tc, and the central thickness Tc is a radial-direction thickness from the inner surface of the eccentric member 26 to the top surface 70*af* of the spring support surface 70*a*, and is set to be smaller than the end portion thickness Te that is a thickness from the inner surface of the eccentric member 26 to each of both circumferential-direction end portions of the spring support surface 70*a*.

According to this configuration, the concave portion 70 is formed in such a way as to be concave on the eccentric member 26, and even when a load is applied to the circumferential-direction end portion of the spring support surface 70*a*, high strength on a circumferential-direction end side of the concave portion 70 can prevent the end portion of the spring support surface 70*a* from being damaged.

(3) In the valve opening-closing timing control device 100 of (1) or (2), it is preferable that the two spring members 71 are arranged to be shifted from each other in the circumferential direction of the concave portion 70.

According to this configuration, using the two spring members 71 enables the external teeth portion 30A of the input gear 30 to be kept in a state of meshing with the internal teeth portion 25A of the output gear 25 even when one of the spring members 71 is damaged.

(4) In the valve opening-closing timing control device 100 of any one of (1) to (3), it is preferable that the top surface 70*af* of the concave portion 70 is formed into the rough surface RF.

According to this configuration, the rough surface RF suppresses a movement of the spring member 71 even when external force of displacing the spring member 71 inside the concave portion 70 in the circumferential direction is applied to the spring member 71.

INDUSTRIAL APPLICABILITY

This disclosure can be used in a valve opening-closing timing control device.

A valve opening-closing timing control device according to this disclosure includes: a driving-side rotor that rotates around a rotation axis synchronously with a crankshaft of an internal combustion engine; a driven-side rotor that is arranged on an inner side of the driving-side rotor coaxially with the rotation axis and rotates integrally with a camshaft for opening and closing a valve of the internal combustion engine; and a phase adjustment mechanism that adjusts a relative rotational phase between the driving-side rotor and the driven-side rotor, wherein the phase adjustment mechanism includes: an internal-teeth output gear that rotates integrally with the driven-side rotor around the rotation axis as a common axis; an external-teeth input gear that has a smaller number of teeth than the output gear, is arranged on an inner side of the output gear, and rotates around an eccentric axis oriented in parallel to the rotation axis; a coupling member that links the input gear to rotation of the driving-side rotor; an eccentric member that meshes an external teeth portion of the input gear with an internal teeth portion of the output gear; and an electric actuator that drives the eccentric member to rotate around the rotation axis, a concave portion is formed on the eccentric member, and is concave from an outer surface of the eccentric member inward in a radial direction in such a way as to allow a spring member to be arranged in the concave portion, the spring member applies biasing force of meshing the external teeth portion of the input gear with the internal teeth portion of the output gear, the concave portion includes a spring support surface that receives biasing force of the spring member, the spring support surface includes a top surface, and, when viewed in a direction along the eccentric axis, the top surface has a smaller protrusion amount at a circumferential-direction central position of the spring support surface, as compared to an eccentric arc surface whose center is the eccentric axis.

According to this feature configuration, the spring member fitted into the concave portion applies the biasing force from the spring support surface of the concave portion toward an inner circumference direction of the input gear, and thereby keeps the external teeth portion of the input gear in a state of meshing with the internal teeth portion of the output gear. The concave portion includes the spring support surface that receives the biasing force of the spring member. When viewed in the direction along the eccentric axis, the top surface on the spring support surface is formed as an arc-shaped surface whose curvature radius is larger in such a way that the spring support surface has the smaller protrusion amount at the circumferential-direction central position of the spring support surface, as compared to the eccentric arc surface whose center is the eccentric axis. Thereby, a phenomenon of a fluctuation in the biasing force is suppressed even when the spring member is displaced in the circumferential direction inside the concave portion. The thus-configured valve opening-closing timing control device suppresses a fluctuation in a spring load even when a position of a spring member fluctuates inside a concave portion.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve opening-closing timing control device comprising:

a driving-side rotor that rotates around a rotation axis synchronously with a crankshaft of an internal combustion engine;

a driven-side rotor that is arranged on an inner side of the driving-side rotor coaxially with the rotation axis and rotates integrally with a camshaft for opening and closing a valve of the internal combustion engine; and a phase adjustment mechanism that adjusts a relative rotational phase between the driving-side rotor and the driven-side rotor, wherein the phase adjustment mechanism includes: an internal-teeth output gear that rotates integrally with the driven-side rotor around the rotation axis as a common axis; an external-teeth input gear that has a smaller number of teeth than the output gear, is arranged on an inner side of the output gear, and rotates around an eccentric axis oriented in parallel to the rotation axis; a coupling member that links the input gear to rotation of the driving-side rotor; an eccentric member that meshes an external teeth portion of the input gear with an internal teeth portion of the output gear; and an electric actuator that drives the eccentric member to rotate around the rotation axis, a concave portion is formed on the eccentric member, and is concave from an outer surface of the eccentric member inward in a radial direction in such a way as to allow a spring member to be arranged in the concave portion, and the spring member applies biasing force of meshing the external teeth portion of the input gear with the internal teeth portion of the output gear 25, and the concave portion includes a spring support surface that receives biasing force of the spring member, the spring support surface includes a top surface, and, when viewed in a direction along the eccentric axis, the top surface has a smaller protrusion amount at a circumferential-direction central position of the spring support surface, as compared to an eccentric arc surface whose center is the eccentric axis.

2. The valve opening-closing timing control device according to claim 1, wherein the eccentric member has a cylindrical shape including a cylindrical internal space whose center is the eccentric axis, and the eccentric member has a central thickness, and the central thickness is a radial-direction thickness from an inner surface of the eccentric member to the top surface of the spring support surface, and is set to be smaller than an end portion thickness that is a thickness from the inner surface of the eccentric member to each of both circumferential-direction end portions of the spring support surface.

3. The valve opening-closing timing control device according to claim 1, wherein a pair of the spring members are arranged to be shifted from each other in a circumferential direction of the concave portion.

4. The valve opening-closing timing control device according to claim 2, wherein a pair of the spring members are arranged to be shifted from each other in a circumferential direction of the concave portion.

5. The valve opening-closing timing control device according to claim 1, wherein the top surface of the concave portion is formed into a rough surface.

6. The valve opening-closing timing control device according to claim 2, wherein the top surface of the concave portion is formed into a rough surface.

* * * * *